United States Patent [19]

Holenstein

[11] Patent Number: 4,546,286

[45] Date of Patent: Oct. 8, 1985

[54] ELECTRON TUBE, IN PARTICULAR A TRANSMITTER TUBE

[75] Inventor: Hans Holenstein, Schmiedhof, Switzerland

[73] Assignee: BBC Brown, Boveri & Company, Limited, Baden, Switzerland

[21] Appl. No.: 517,678

[22] Filed: Jul. 27, 1983

[30] Foreign Application Priority Data

Jul. 27, 1982 [CH] Switzerland ..... 4554/82

[51] Int. Cl.[4] ..... A47B 96/00

[52] U.S. Cl. ..... 313/296; 313/37; 313/39; 313/285

[58] Field of Search ..... 313/39, 37, 296, 293, 313/285

[56] References Cited

U.S. PATENT DOCUMENTS

| | | | |
|---|---|---|---|
| 2,022,212 | 11/1935 | Lippincott et al. | 313/285 X |
| 2,277,858 | 3/1942 | Skellett | 313/285 X |
| 2,398,609 | 4/1946 | Werner | 313/285 X |
| 2,510,171 | 6/1950 | Clark | 313/37 X |
| 3,564,318 | 2/1971 | Beggs | 313/39 X |
| 3,567,988 | 3/1971 | Randmer et al. | 313/285 X |

FOREIGN PATENT DOCUMENTS 987461 3/1965 United Kingdom .

*Primary Examiner*—Robert Lindsay
*Attorney, Agent, or Firm*—Oblon, Fisher, Spivak, McClelland & Maier

[57] ABSTRACT

In a cathode for a heavy-duty electron tube, the cathode wires (5) lying on the surface (11) of a cylinder between two rigidly constructed connector rings (7, 8) have the form of a surface line with changing pitch. The cathode wires are connected by a support ring (6). The thermal expansion of the cathode wires during operation results only in a shifting on the surface (11). In this manner the cylindrical shape of the cathode and thus the distance to the control grid are maintained without the expensive spring suspension device used in the cage cathode.

9 Claims, 2 Drawing Figures

ELECTRON TUBE, IN PARTICULAR A TRANSMITTER TUBE

FIELD OF THE INVENTION

The invention relates to an electron tube, in particular a transmitter tube, with coaxial electrode construction and a directly heated cathode, consisting of individual, parallel cathode wires arranged in the form of a cylindrical surface between stacked connector rings and rigidly connected by connecting collars with concentric current leads.

BACKGROUND OF THE INVENTION

Such a cathode is known in the industry as a meshed cathode. It exhibits cathode wires arranged crosswise that form, between rigid, stacked connector rings, a meshed net in the shape of a cylindrical surface for the heater current. However, the cylindrical shape of the cathode is preserved only in the cold condition. In contrast, when the cathode wires are heated by the heater current to the usual high emission temperatures during operation of the tube, the wires become longer as a result of thermal expansion of the wire material. Because the wires are firmly connected at their ends with the rigid connector rings, the change in length results in a barrel-shaped bulge in the central portion of the meshed net cylinder.

Since the distance between the nearest control grid and the cathode is only a few millimeters, the operating performance of the tube changes considerably as a result of the bulge.

To minimize the effect of the thermal expansion of the cathode on the operating performance, another kind of cathode was developed, which is known as the cage cathode. It is characterized by cathode wires running parallel to the axis of the tube that, on the one hand, are fastened to a rigid lower connector ring and, on the other hand, are connected to an upper connector ring that is prestressed by a central spring. The wires are held under tension over the connector ring by the spring so that their change in length in the direction of the tube axis is taken up and compensated. The upper current supply takes place by way of a flexible lead in the shape of a metal bellows. The flexible, cushioned construction of the upper connector ring results in a significant increase in production cost.

OBJECT OF THE INVENTION

The aim of this invention is to make a cathode wherein the influence of the thermal expansion of the cathode wires is eliminated simply and without a flexible connection.

SUMMARY OF THE INVENTION

The solution according to the invention is to have the cathode wires lie in cylindrical surface lines whose pitch between the connector rings changes sign, and to have the cathode wires interconnected by at least one support ring arranged between the connector rings.

According to a preferred embodiment, the cathode wires are shaped like a horizontal, symmetrical V and are connected to the connector rings at precisely superposed points.

The invention is explained below with reference to the drawing.

DETAILED DESCRIPTION OF THE PRESENTLY PREFERRED EMBODIMENT

Figure 1:
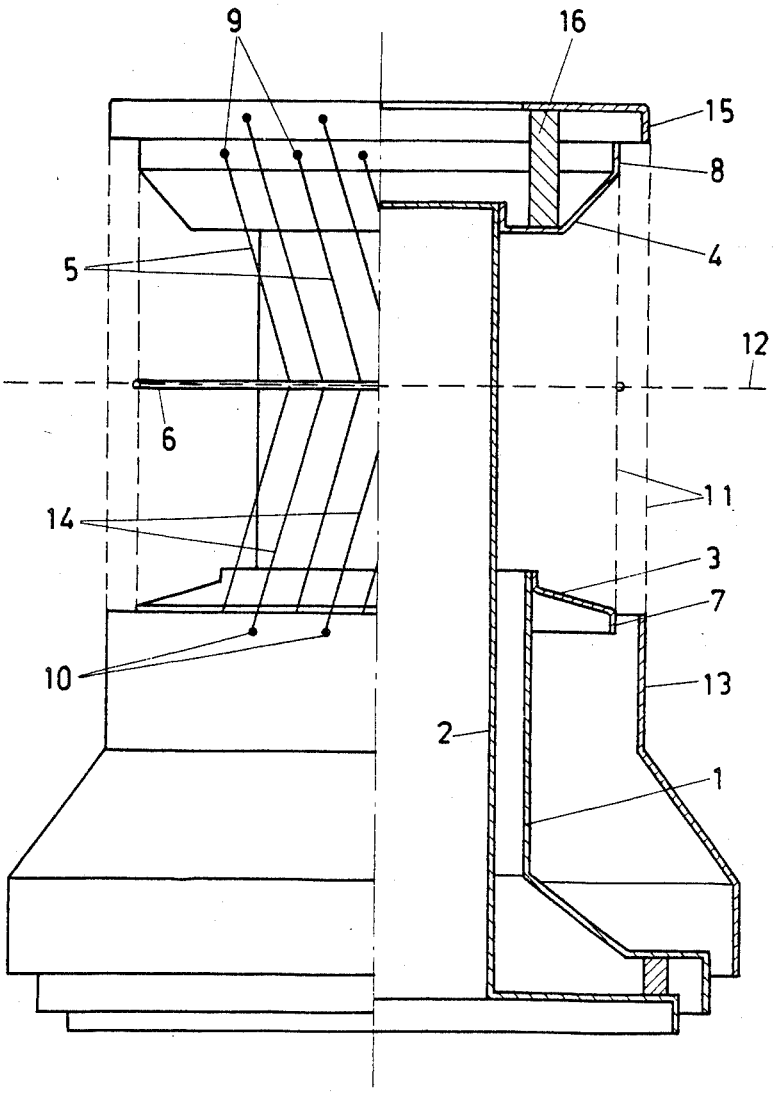
FIG. 1 shows a preferred embodiment of the cathode according to the invention with V-shaped cathode wires.

The cathode according to the invention shown in FIG. 1 is mechanically constructed of an upper current lead 2 and a lower current lead 1 that are arranged as concentric tubes within the cathode. On the upper ends of the tubes are an upper connecting collar 4 and a lower connecting collar 3, respectively, whose outer edges merge with the connector rings 7 and 8. Between the upper connector ring 8 and the lower connector ring 7 cathode wires 5 lie on the cylindrical surface delimited by the connector rings. The ends of these wires are connected rigidly and conductively at connections 9 to the corresponding connector rings.

The cathode wires 5, of which for reasons of clarity only a few are shown in FIG. 1, form lines on the cylindrical surface that, beginning at the lower connector ring 7, run with a constant positive pitch to the middle plane 12 between the connector rings 7 and 8, and from there with a constant negative pitch to the upper connector ring 8. Accordingly, with this preferred embodiment they are shaped like a symmetrical, horizontal V. The cathode wires 5 are rigidly interconnected at the point of the V by a support ring 6 whose diameter is adpated to the diameters of the connector rings 7 and 8 in such a way that the connected cathode wires 5 form a cylindrical surface 11 with a constant diameter.

The heater current for the cathode wires 5 is supplied via the current leads 1 and 2 and the connecting collars 3 and 4 to the connector rings 7 and 8. It is thus clear that these parts are made of a material that conducts electricity well and that also has sufficient mechanical strength to resist the thermal forces arising during operation of the tube. Moreover, the connecting rings 7 and 8, which at least peripherally are heated to high temperatures by the hot cathode wires, are best made of a metal having a high melting point, such as molybdenum.

Special attention must be paid also to the connections between the cathode wires and the connector rings, on the one hand, and the cathode wires and the support ring, on the other hand, which are subjected to thermal and mechanical stresses. According to a preferred embodiment, these connections are made by using a suitable welding technique, for example, spot welding. Thus, it is important that the materials making up the parts to be joined are selected with a view of their weldability. Since the cathode wires 5 are made preferably of thoriated wolfram, there is an advantage to making the support ring 6 out of wolfram.

Figure 2:
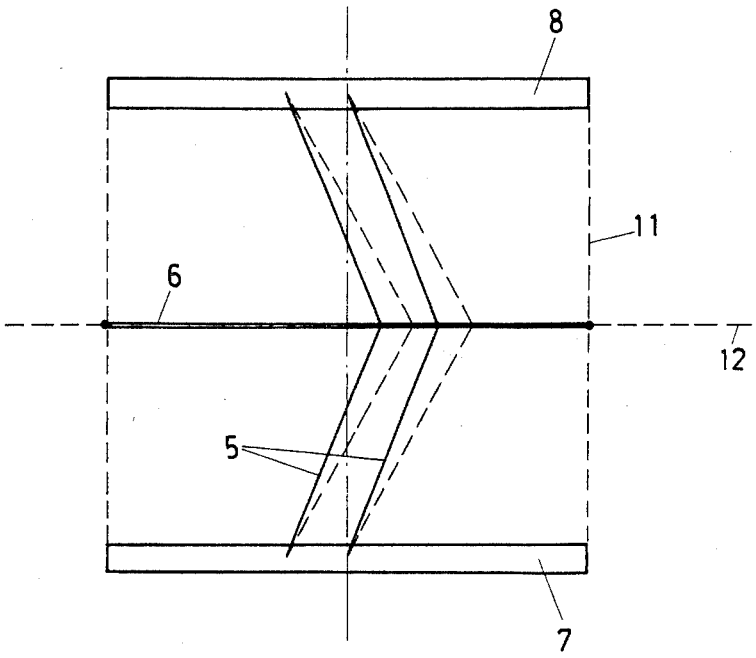
FIG. 2 shows the behavior of the cathode wires of a cathode according to the invention when heated.

The behavior of the cathode wires of a cathode according to the invention when being heated is represented by the example of two wires in FIG. 2. In the cold condition the cathode wires 5 lie on the already described cylindrical surface 11 between the connector rings 7 and 8. When the cathode wires are brought to emission temperature during operation, they become longer owing to thermal expansion. Since the ends of the wires are fixed in position on the rigid connector rings, the change in length is taken up by a shifting of the wires in the area between the connector rings. The shaping of the cathode wires according to the invention makes it possible for this shift to take place in a preferred direction, which, in the case of the V-shaped wires of the embodiment shown in FIG. 1, is predetermined by the point of the V, that is, the point of the V shifts in the middle plane 12 for reasons of symmetry.

The support ring 6, which forms a rigid coupling between the cathode wires and which in contrast to the connector rings 7 and 8 can move freely, causes the shifting to take place on the cylindrical surface 11. The cathode wires 5 then take up the position indicated by the broken line, whereby the support ring, in contrast to the cold condition, rotates only around the axis of the cathode.

To increase the stability of the cylindrical surface formed by the cathode wires 5, it is also advantageous to provide additional support rings over and above the support ring 6 situated in the middle plane 12 that are arranged at regular intervals from one another between the connector rings 7 and 8 and that are connected to the cathode wires 5.

In particular, the stability of the cathode cylindrical surface can be further improved if the cylindrical surface is connected, at least in the middle plane, to a rotatable centering device, which, for example, can be connected to the lower current lead 2 and is sure to prevent lateral shifting of the cylindrical surface in the middle plane but in contrast allows rotating shifts around the axis of the tube that arise during heating of the cathode according to the invention.

All told, in the cathode according to the invention the cylindrical surface formed by the cathode wires retains its length as well as its constant diameter,according to a simple method, regardless of whether the cathode wires are cold or at emission temperature.

Owing to the special shaping of the cathode wires in the cathode according to the invention, it is advantageous to adapt the construction of the electron tube control and screen grids to the cathode. This is clear in the example of a grid 13 represented in FIG. 1, which exhibits parallel grid wires 14 between a lower lead tube arranged concentrically to the cathode and an upper grid termination. These wires lie on a cylindrical surface around the cathode and having a configuration corresponding to the cathode wires 5. The grid and cathode wires are arranged in alternating order, that is, the grid wires 14 lie between the cathode wires 5 and vice versa. The upper termination 15 is rigidly connected by a connecting element 16 as shown to the upper connecting collar 4 of the cathode, so that the positions of the grid and cathode wires are fixed relative to one another. This eliminates the need in state-of-the-art tubes for a guide for the one, free-moving grid end, which as a result of the necessary mechanical play can cause differences in the spacing between the electrodes on the order of 10 percent.

With the construction of the grid according to the invention, a largely uniform field distribution in the tube, on the one hand, and increased precision of interelectrode spacing, on the other, are achieved.

Moreover, it is especially advantageous to compensate for the change in pitch of the cathode wires, as seen in FIG. 2 during heating to operational temperature, as compared with the grid wires by selecting for the cathode wires in cold condition a correspondingly greater pitch, so that this difference in pitch will be compensated for by the thermal expansion of the cathode wires during operation.

This ensures that the grid and cathode wires during operation of the tube are parallel to one another and that crossing of wires is definitely eliminated.

An electron tube according to the invention exhibits overall an electrode configuration that is stabile and that can be manufactured with high precision, and thus also exhibits stabile operating performance. This is achieved with very simple and effective design measures that are distinguished, in comparison with other technical solutions, by increased manufacturing economy.

I claim:

1. An electron tube:

(a) with a coaxial electrode design and (b) a directly heated cathode comprising a plurality of separate cathode wires running parallel to one another, (c) said plurality of separate cathode wires being placed on a generatrix of a cylindrical surface between superposed electric connecting rings, (d) said connecting rings being rigidly connected to one another by connecting plates which are in electrical contact with current feeds, (e) said plurality of cathode wires being located on generatrices the pitches of which change sign between said connecting rings, (f) each of said plurality of cathode wires forming an acute angle with said connecting rings, and (g) said plurality of cathode wires being interconnected by at least one support ring which is rotatable relative to said connecting rings.

2. Electron tube as in claim 1, wherein said cathode wires are welded to said connector rings.

3. Electron tube as in claim 1, wherein said cathode wires are welded to said at least one support ring.

4. Electron tube as in claim 1, wherein said cathode wires run symmetrically to the middle plane between said connector rings.

5. Electron tube as in claim 4, wherein said cathode wires run from one of said connector rings to the middle plane with one pitch, and from the middle plane to the other of said connector rings with a second pitch, said second pitch being equal to the first pitch but having the opposite sign.

6. Electron tube as in claim 4, wherein said at least one support ring is connected to said cathode wires in the middle plane.

7. An electron tube comprising:

(a) a first connector ring concentric to and fixed relative to a central axis;

(b) a second connector ring concentric to and fixed relative to the central axis, said first and second connector rings being axially spaced from one another, said first and second connector rings having the same diameter and defining a cylindrical surface therebetween;

(c) at least one support ring disposed between said first and second connector rings, said at least one support ring being concentric to the central axis and having the same diameter as said first and second connector rings but being rotatable relative to the central axis; and (d) a plurality of cathode wires, each of said plurality of cathode wires being in electrical contact at one end with said first connector ring and at the other end with said second connector ring, each of said cathode wires being longer than the axial distance between said first and second connector rings when power is not supplied to the electron tube, being attached to said at least one support ring, and being disposed at least generally in the cylindrical surface, whereby, when power is supplied to the electron tube, causing each of said plurality of cathode wires to heat and to increase in length, the increase in length of each of said plurality of cathode wires causes said at least one support ring to rotate relative to the central axis but does not cause said plurality of cathode wires to move out of the cylindrical surface.

8. Electron tube as in claim 1, wherein:

(a) said cathode is concentrically surrounded by a cylindrical grid comprising a plurality of grid wires that exhibit a form corresponding to that of said plurality of cathode wires and (b) a termination of said cylindrical grid is connected rigidly to said cathode.

9. The electron tube as in claim 8, wherein:

(a) said plurality of grid wires and said plurality of cathode wires run parallel when said cathode is at operating temperature and (b) each of said plurality of grid wires is arranged between two adjacent cathode wires.

* * * * *